US008544781B2

(12) United States Patent
Pan et al.

(10) Patent No.: US 8,544,781 B2
(45) Date of Patent: Oct. 1, 2013

(54) POWER SHREDDER WITH INDIVIDUALLY REMOVABLE COMPONENTS STRUCTURE

(75) Inventors: Guofeng Pan, Dongguan (CN); Herman Yu Ming Chang, Dongguan (CN)

(73) Assignee: Dongguan Futai Electronic Co., Ltd., Dongguan (CN)

( * ) Notice: Subject to any disclaimer, the term of this patent is extended or adjusted under 35 U.S.C. 154(b) by 41 days.

(21) Appl. No.: 13/040,191

(22) Filed: Mar. 3, 2011

(65) Prior Publication Data

US 2012/0223169 A1 Sep. 6, 2012

(51) Int. Cl.
*B02C 19/00* (2006.01)

(52) U.S. Cl.
USPC ..... 241/101.2

(58) Field of Classification Search
USPC ..... 241/100, 101.2
See application file for complete search history.

(56) References Cited

U.S. PATENT DOCUMENTS 7,543,768 B2 * 6/2009 Cohen et al. ..... 241/36
2005/0279869 A1 * 12/2005 Barklage ..... 241/100

* cited by examiner

*Primary Examiner* — Dana Ross
*Assistant Examiner* — Matthew G Katcoff
(74) *Attorney, Agent, or Firm* — Jackson IPG PLLC

(57) ABSTRACT

A power shredder with individually removable components structure comprising two main removable components: the power component and the shredding mechanism component. The power and the shredding mechanism components can be individually attached and removed from the waste collector of the power shredder. The power component further comprises two main parts: a detachable motor and a detachable gear assembly. When any of the power component, shredding mechanism component, motor or gear assembly should become defective, the use can simply remove and replace the defective part with a new part.

7 Claims, 6 Drawing Sheets

POWER SHREDDER WITH INDIVIDUALLY REMOVABLE COMPONENTS STRUCTURE

FIELD OF THE INVENTION

Present invention relates to a power shredder, more specifically, a power shredder with individually removable components structure.

BACKGROUND OF THE INVENTION

Conventional power shredder typically comprises a shredding mechanism cover head and a waste collector. The shredding mechanism cover head usually attaches to the top open of the waste collector. Typically, shredding mechanism cover head includes a motor, a gear assembly and a rotary cutter apparatus. Because of the one unit design of the conventional power shredder any defects in the shredding mechanism cover head parts, the user generally have to send the entire shredder back to the shop for repair. The wait time for repairing might take some time and for the user it is troublesome to have to wait for the shredder to be repair at the mean time.

Furthermore, for the shredder manufacturers, retailer or the service department the process to repair a shredder might also prove to be troublesome. Different model of shredders might have different configuration and use different model of parts. Therefore, repairing a shredder some time may take a relatively high cost and time for the manufacturers, retailer or the service department.

SUMMARY OF THE INVENTION

In order to overcome the above-mentioned shortcoming, the objective of present invention provides a power shredder with individually removable components structure that is easier for maintenance and repairing, and thus, brings more convenience to the users.

In order to achieve this objective of providing power shredder with individually removable components structure that is easier for maintenance and repairing, the present invention provides a power shredder comprising: a waste collector, an independent power component and an independent shredding mechanism component. Both the power component and shredding mechanism can be individually attached to the top opening of the waste collector. Furthermore, the power component can be connected to the shredding mechanism component for providing the power source.

The power component comprises a detachable motor and a detachable gear assembly. The detachable motor can be connected to the detachable gear assembly. In addition, the detachable gear assembly can further connected to the shredding mechanism component.

In addition to a detachable motor and a detachable gear assembly, the power component further comprises a top cover and a bottom cover. The top cover and bottom cover can be joined to form a power casing to enclose the detachable motor and detachable gear assembly. On one side of the power casing, a connecting opening is set up to first accommodate a power output interface of the detachable gear assembly. A portion of the power output interface is revealing through the connecting opening of the power casing.

The top side of the waste collector having a power component sliding track to accommodate the power component sliding trough on the bottom of the bottom cover of the power component. The power component is slide in and fixed onto the top opening of the waste collector through the engagement of the sliding track and sliding trough.

The above-mentioned detachable gear assembly comprises a left cover, a right cover, an input gear, an intermediary gear and a output gear. The left and right cover can be joined to form a gear casing. The input, intermediary and output gear are connected with each other in this orderly fashion. The combined input, intermediary and output gear is fixed inside the gear casing. The gear casing has a connection opening on the frontal and back end. The shaft of the motor connects with the input gear through the frontal opening. The center of output gear has an output interface for relaying power. The position of the output interface is also situated and connected to the side of the back opening of gear casing.

The shredding mechanism component comprises a top cover, a bottom cover and a rotary cutter apparatus. The top and bottom cover can be joined to form a rotary cutter casing for enclosing the rotary cutter apparatus. The top of rotary cutter casing has a paper feeding slot.

The top of opening of the above-mentioned waste collector has a shredding mechanism component sliding track to accommodate a shredding mechanism component sliding trough on the bottom of the rotary cutter casing of the shredding mechanism component. The shredding mechanism component is slide in and fixed onto the top opening of the waste collector through the engagement of the shredding mechanism component sliding track and sliding trough.

Whereas, on the side the power component, adjacent to the shredding mechanism component, has a first interface installed. On the adjacent side of the shredding mechanism has a second connecting interface installed to be joined with the first interface on the power component.

Adopting the above-described shredder structure, the present invention has the advantages over the conventional power shredders in that: the power shredder of the present invention comprises two main components: the power component and the shredding mechanism component. Both these component can be individually assembled and removed from a waste collector by the users. If either the power or shredding mechanism component should become defective, the user can simply remove the defective component and replace it with a new one. In addition, with this design, the manufacturers can make these components into a standard and universal shredder parts, reducing the production cost and making maintenance and repairing shredders easier and faster.

Furthermore, since only the defective component needs to be replaced, the user can simply purchase the replacement component and replace the component himself, thus, saves the time and trouble to bring in the broken shredder to the shop for repairing.

DETAILED DESCRIPTION OF THE PREFERRED EMBODIMENTS

Figure 1:
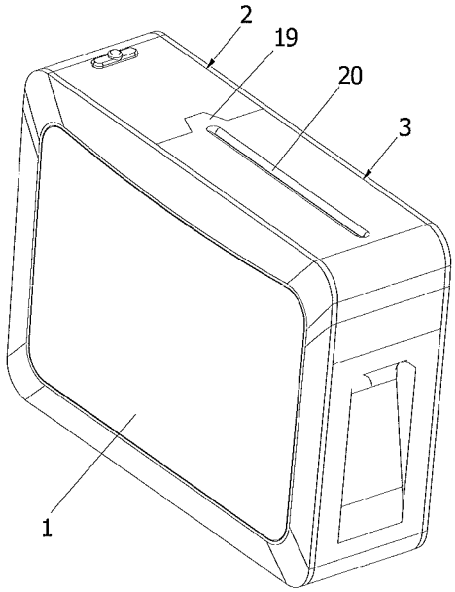
FIG. 1 is a structural illustration of the present invention.
Figure 2:
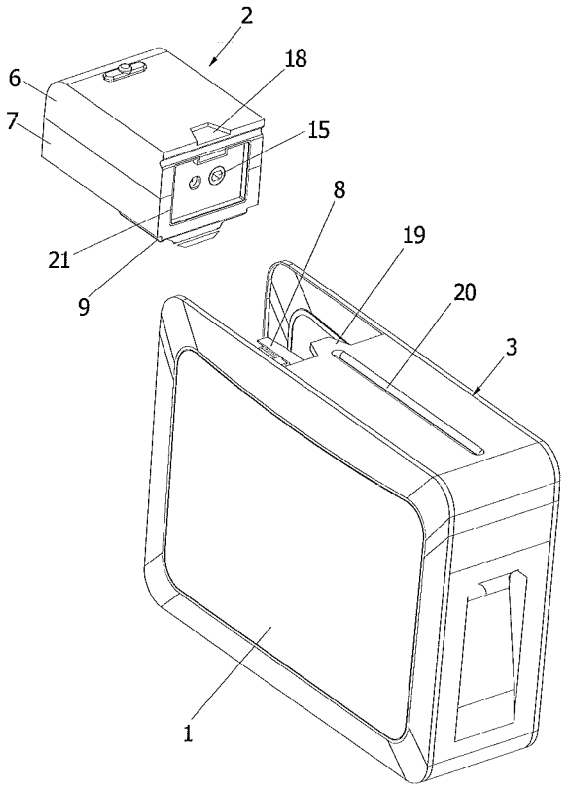
FIG. 2 is a structural illustration of the power component.
Figure 3:
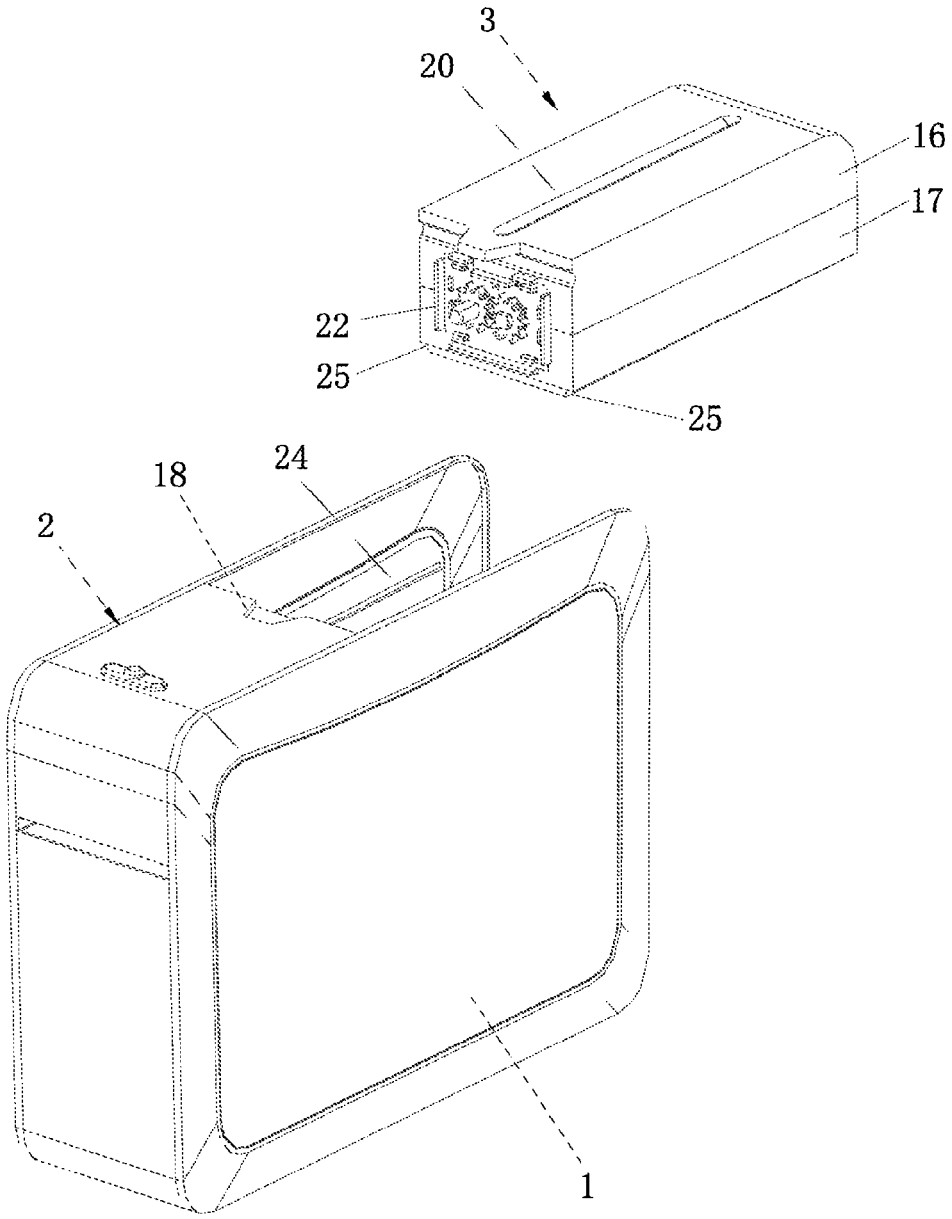
FIG. 3 is a structural illustration of the shredding mechanism component.
Figure 4:
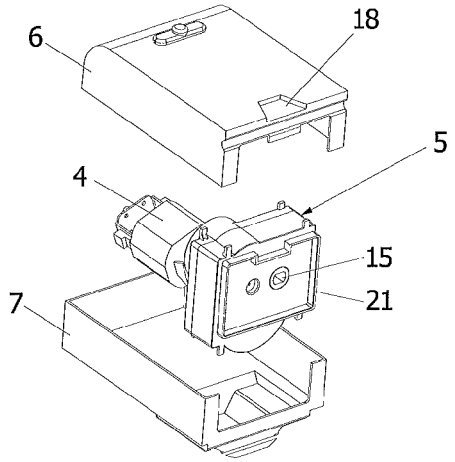
FIG. 4 is a disassembled illustration of the power component.
Figure 5:
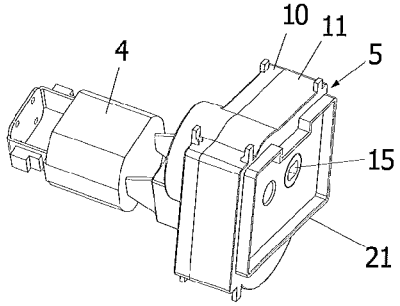
FIG. 5 is a structural illustration of the detachable motor and detachable gear assembly of the power component.
Figure 6:
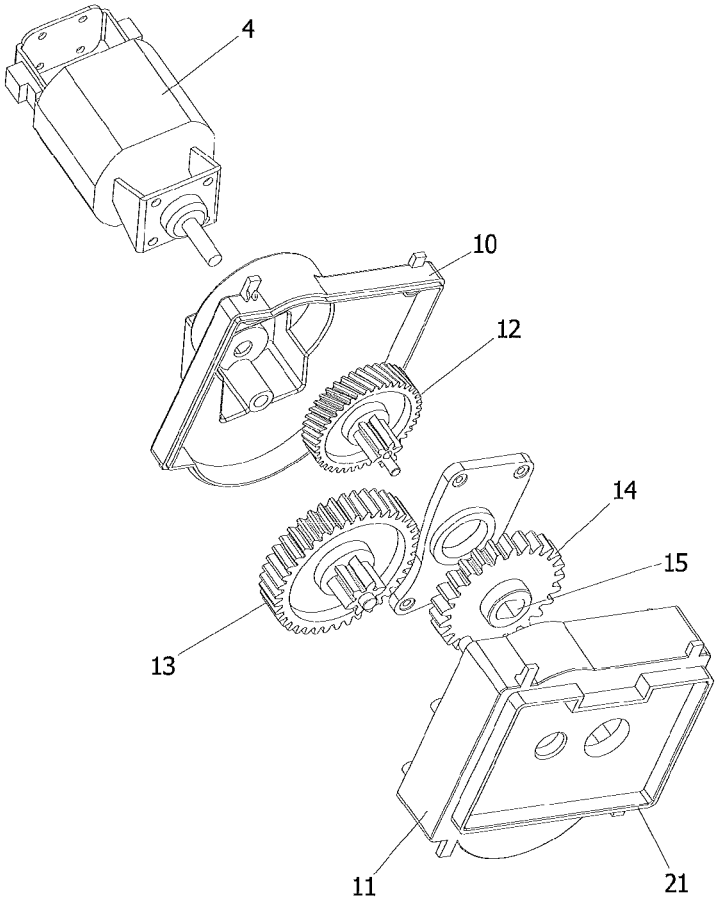
FIG. 6 is a disassemble illustration of FIG. 5.
Figure 7:
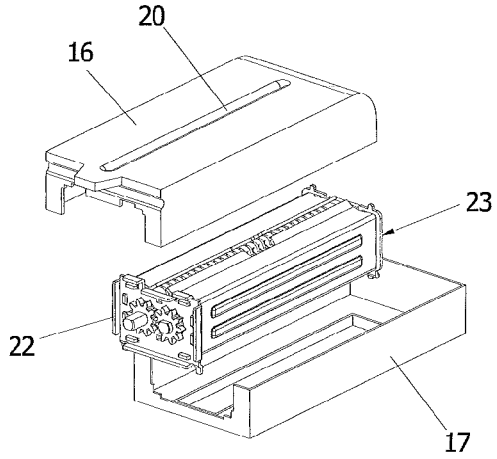
FIG. 7 is a structural illustration of the shredding mechanism component.
Figure 8:
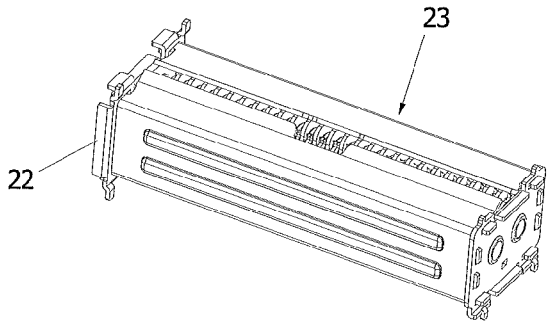
FIG. 8 is a structural illustration of the rotary cutters.

The following describe the preferred embodiment of the invention in detail: As illustrated in FIG. 1-8, the present invention of Power Shredder with Individually Removable Components Structure comprising a waste collector 1, a power component 2 and a shredding mechanism component 3. The power component 2 can be assembled and removed from the top opening of the waste collector 1; the shredding mechanism 3 can also be assembled and removed from the top opening of the waste collector 1; the power component 2 and the shredding mechanism component can be connected with each other.

In order for the present invention of power shredder to operate normally, both the power component 2 and the shredding mechanism component 3 need to be assembled onto the waste collector 1 and connected with each other. When either or both the power component and shredding mechanism component becomes defective, the user simply remove the defective component(s) and replace it or them with new ones.

In an another preferred embodiment, the power component comprises with two main parts: a detachable motor 4 and a detachable gear assembly 5. The detachable motor 4 can be connected or disconnected with the detachable gear assembly 5. The detachable gear assembly 5 can be connected or disconnected with shredding mechanism component 3. When any of the detachable motor 4, the detachable gear assembly 5 or the shredding mechanism should become defective, the user can simply replace the defective part with a new one.

In an another preferred embodiment, the power component 2 comprises a top cover 6, a bottom cover 7, a detachable motor 4 and a detachable gear assembly 5. The top cover 6 can joined with the bottom cover 7 to form a power casing; the detachable motor 4 can be connected with the detachable gear assembly 5 and the joined detachable motor 4 and detachable gear assembly 5 is enclosed by the power casing. On one side of the power casing has a connecting opening and on one side of the gear assembly 5 has a power output interface 15; a portion of the power output interface 15 is revealing through the connecting opening of the power casing. The connecting opening and power output interface allows the power component 2 to connect with the shredding mechanism 3, wherein, the power component transfers power through the power output interface 15 to the shredding mechanism component 3.

In this preferred embodiment, top side of waste collector 1 is provided with a power component sliding track 8 to accommodate a power component sliding trough 9 on the bottom of the bottom cover 7. Wherein, power component 2 is slide in and fixed onto the top opening of waste collector 1 through the engagement of the power component sliding track 8 and sliding trough 9. Power component sliding track 8 and sliding trough 9 set up allows the users easier attachment and removal of the power component from the waste collector 1.

Also in this preferred embodiment, gear assembly 5 comprises a left cover 10, a right cover 11, an input gear 12, an intermediary gear 13 and an output gear 14. Wherein, intermediary gear 13 can be a multiple number of gears in accordance with the specification of the gear assembly 5. Left cover 10 and right cover 11 is joined to form a gear casing. Input gear 12, intermediary gear 13 and output gear 14 are connected with each other in this orderly fashion and the combined input gear 12, intermediary gear 13 and output gear 14 is enclosed by the gear casing. Gear casing has a connection opening on the frontal and back end. The frontal connection opening receives the shaft from detachable motor 4 and connects it with input gear 12. The center of output gear 14 has an output interface 15 for relaying power. The output gear 14 can be design as such that the center axle of output gear 14 forms an output interface 15. Output interface 15 can be set up to the side of output gear 14 adjacent to the back connection opening of the power casing. Output interface 15 then connects with the back connection opening of the power casing. In this set up, output interface 15 relays the output power from gear assembly 5 to shredding mechanism 3. When power component 2 connects with shredding mechanism component 3, the rotary cutter of the shredding mechanism component 3 automatically insert into power output interface 15 to complete the power connection between the power component and shredding mechanism component.

In an another preferred embodiment, shredding mechanism 3 comprises a top cover 16, a bottom cover 17 and a rotary cutter apparatus 23. Top cover 16 and bottom cover 17 can be joined to form a rotary cutter casing for enclosing rotary cutter apparatus 23. Top cover 16 has a paper feeding slot 20. Rotary cutter apparatus 23 comprises a pair of paralleling cutters with multiple blades. On one side of the cutters has a fixing gear for each of the cutters. The two fixing gear also engages with each other on the rotary cutter apparatus 23 in order to allow both cutters to turn simultaneously. The rotary cutter of the rotary cutter apparatus 23 is fixed onto a frontal base and a back base by a turn bearing; the frontal base and the back base are fixed into the rotary cutter casing. A portion of the rotary cutters of the rotary cutter apparatus 23 is protruding out from the rotary cutter casing.

In this preferred embodiment, the top side of waste collector 1 has a shredding mechanism component sliding track 24 to accommodate a shredding mechanism component sliding trough 25 on the bottom of the bottom cover 17. Wherein, the shredding mechanism component 3 is slide in and fixed onto the top opening of the waste collector 1 through the engagement of the shredding mechanism component sliding track 24 and sliding trough 25. The shredding mechanism component sliding track 24 and sliding trough 25 set up allows the user easier attachment and removal of shredding mechanism component 3 from waste collector 1.

In this preferred embodiment, on one side of the power component, adjacent to the shredding mechanism component, has a first connection interface 21. And more specifically, first connection interface 21 situates to the right cover 10 of the gear assembly 5. In addition, on one side of shredding mechanism component 3, adjacent to power component 2, has a second connection interface 22. And more specifically, second connection interface 22 situates on the side of rotary cutter apparatus 23 adjacent to the power component 2. First connection interface 21 and second connection interface 22 are designed as such that second interface 22 can receives first interface 21 as a matching coupling in order to allow secure connection of the rotary cutters of shredding mechanism 3 with the power output interface 15 of power component 2.

In this preferred embodiment, the on one side of top cover 6 of power component 2, adjacent to shredding mechanism 3, has a positioning aperture 18 and one on side of top cover 16 of shredding mechanism component 3, adjacent to power component 2, has a positioning piece 19. When power component 2 connects with shredding mechanism 3, positioning piece 19 couples with positioning aperture 18 to secure the connection between power component 2 and shredding mechanism 3.

In this preferred embodiment, other than already described therein, rotary cutter 23 apparatus adopts the common design structures, hence the detail description of the rotary cutter is omitted herein.

It should be appreciated that the present invention is capable of a variety of embodiments and various modifications by those skilled in the art, and all such variations or changes shall be embraced within the scope of the following claims.

The invention claimed is:

1. A power shredder with individually removable components comprising a waste collector, a power component and a shredding mechanism component;

wherein a set of power component sliding tracks is provided at a top opening of the waste collector to accommodate a set of power component sliding troughs provided on a bottom of the power component; the power component slides into the top opening of the waste collector on the power component sliding tracks and is secured to the waste collector through the engagement of the power component sliding tracks and the power component sliding troughs, and the power component is detachable from said waste collector through the disengagement of the power component sliding tracks and power component sliding troughs;

a set of shredding mechanism component sliding tracks is provided at the top opening of the waste collector to accommodate a set of shredding mechanism component sliding troughs provided on a bottom of the shredding mechanism component;

the shredding mechanism component slides into the top opening of the waste collector through the shredding mechanism component sliding tracks and is secured on the waste collector through the engagement of the shredding mechanism component sliding tracks and the shredding mechanism component sliding troughs, and the shredding mechanism component is detachable from said waste collector through the disengagement of the shredding mechanism component sliding tracks from the shredding mechanism component sliding troughs; said power component connects to said shredding mechanism component and is detachable from said shredding mechanism component.

2. The power shredder with individually removable components structure as claimed in claim 1, wherein said power component comprises a detachable motor and a detachable gear assembly; said detachable motor connects to said detachable gear assembly; and said detachable gear assembly farther connects to said shredding mechanism component and is detachable from said shredding mechanism component.

3. The power shredder with individually removable components structure as claimed in claim 1, wherein said power component comprises a top cover, a bottom cover, a detachable motor and a detachable gear assembly; said top cover joins with the bottom cover to form a power casing that encloses said detachable motor and detachable gear assembly; said detachable motor connects to the said detachable gear assembly inside said power casing; on one side of said power casing has a connection opening and on one side of said gear assembly has a power output interface; and said power output interface is revealing through said connection opening.

4. The power shredder with individually removable components structure as claimed in claim 2 or 3, wherein said gear assembly comprises a left cover, a right cover, an input gear, an intermediary gear and an output gear; said left cover and right cover joins to form a gear casing; said input gear, intermediary gear and output gear connects to each other in the aforesaid order; wherein said gear casing houses the connected input gear, intermediary gear and output gear; said gear casing has having a connection opening on the frontal and back side; the shaft of said motor extends through the said gear casing frontal connection opening and connects with said input gear; a power output interface positioned align with the center of said output gear and adjacent to said back opening of said gear casing; and said power output interface also aligns with said back connection opening.

5. The power shredder with individually removable components structure as claimed in claim 4, wherein said shredding mechanism component comprises a top cover, a bottom cover and a rotary cutter apparatus; said top cover and bottom cover joins to form a rotary cutter casing and houses said rotary cutter apparatus; said rotary cutter apparatus comprises a pair of paralleling cutters with multiple blades; wherein, a portion of said cutters extends out from one side of said rotary cutter casing; and said top cover has a feeding slot on the top side.

6. The power shredder with individually removable components structure as claimed in claim 4, wherein a first connection interface is provided on one side of said power component, adjacent to said shredding mechanism component; a second matching connection interface is provided on one side of shredding mechanism component, adjacent to said power component; and wherein, said first connection interface couples with said second connection interface.

7. The power shredder with individually removable components structure as claimed in claim 6, wherein a positioning aperture is provided on said top cover, to the adjacent side of said shredding mechanism component, of said power component; a positioning piece is provided on said top cover, to the adjacent side of said power component, of said shredding mechanism component; and wherein, said power component and shredding mechanism component are connected together by coupling said position piece with said positioning aperture.

* * * * *